United States Patent [19]

Potter

[11] 4,328,485

[45] May 4, 1982

[54] BINARY ALARM

[76] Inventor: Bronson Potter, R.F.D. #1, Mason, N.H. 03048

[21] Appl. No.: 211,176

[22] Filed: Nov. 28, 1980

Related U.S. Application Data

[63] Continuation of Ser. No. 123,993, Feb. 25, 1980, abandoned.

[51] Int. Cl.[3] ..... G08B 3/10

[52] U.S. Cl. ..... 340/384 E; 340/384 R

[58] Field of Search ..... 340/384 E, 384 R; 331/112, 74, 116

[56] References Cited

U.S. PATENT DOCUMENTS

| | | | |
|---|---|---|---|
| 3,277,465 | 10/1966 | Potter | 340/384 R X |
| 3,311,868 | 3/1967 | Cupp | 340/384 R X |
| 3,447,151 | 5/1969 | Potter | 340/384 R X |
| 3,534,363 | 10/1970 | Ausband | 340/388 |
| 3,721,840 | 3/1973 | Yamada | 340/384 R X |
| 3,815,129 | 6/1974 | Sweany | 340/388 |
| 3,825,836 | 7/1974 | Pyles | 340/384 R X |
| 3,879,726 | 10/1975 | Sweany | 340/384 E |
| 3,890,612 | 6/1975 | Sweany | 340/384 E |
| 4,047,377 | 9/1977 | Banks | 340/384 R X |

*Primary Examiner*—Harold I. Pitts

[57] ABSTRACT

An audible alarm device comprising a transducer which resonates at its natural frequency in an alarm mode to produce an alarm tone, this same transducer being driven, e.g. in a "ready" mode, by a non-resonant background signal generator in the manner to produce background sound of relatively low intensity which can indicate that the alarm circuit is functioning but is not in its alarm mode.

20 Claims, 7 Drawing Figures

FIG. 6
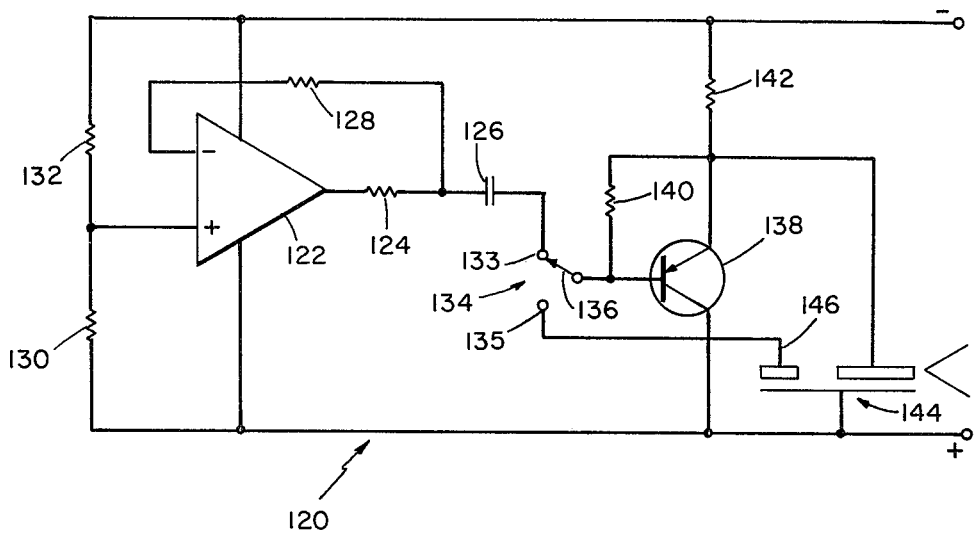
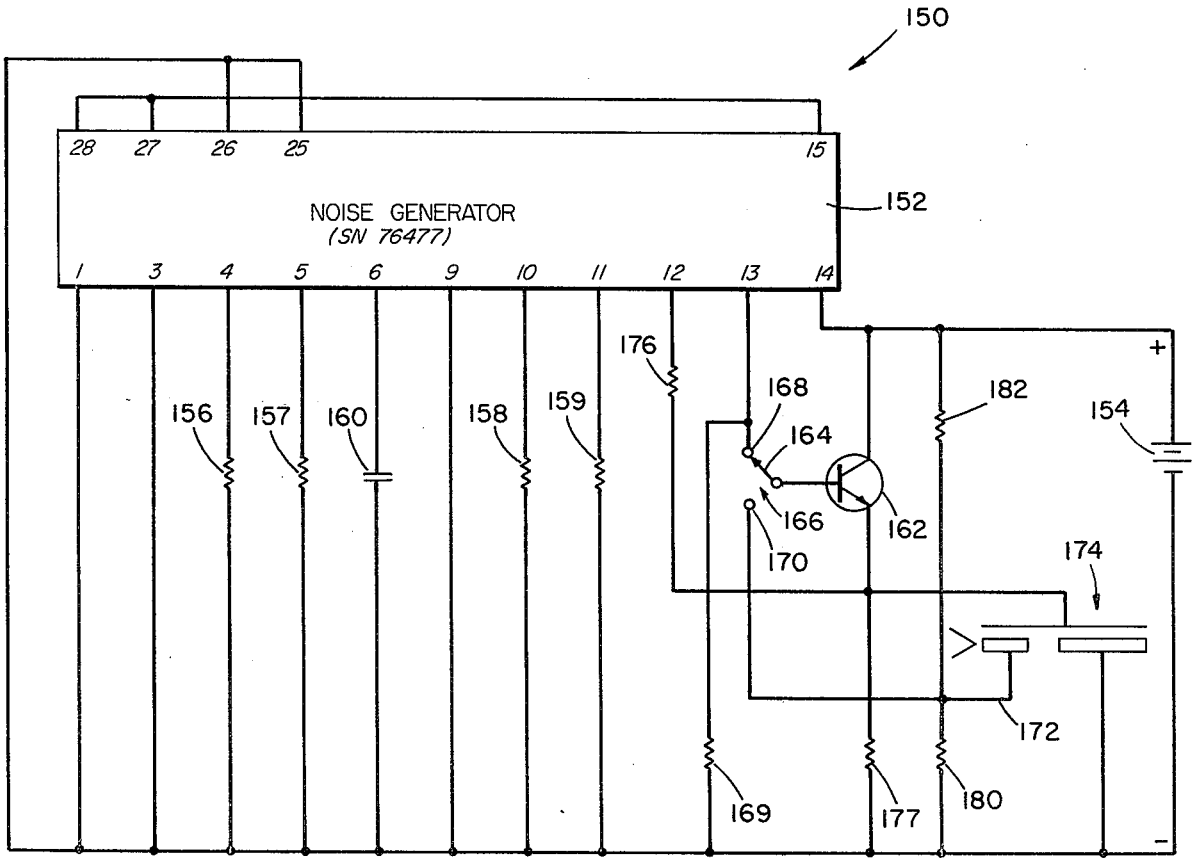
FIG. 7

BINARY ALARM

This is a continuation of application Ser. No. 123,993, filed Feb. 25, 1980, now abandoned.

BACKGROUND OF THE INVENTION

Electronic, resonant sonic alarm devices are well-known and widely used to provide an inexpensive and effective means for signaling emergency conditions. These are available under the trademark Sonalert from P. R. Mallory of Indianapolis, Ind. and follow the teachings of my U.S. Pat. No. 3,277,465. See also my U.S. Pat. No. 3,447,151. (Both hereby are incorporated by reference.) These devices use an inexpensive transducer, which has a sharp natural resonant frequency. The drive circuit utilizes this natural frequency, of the transducer itself, to determine the frequency of the driving oscillating circuit.

In some high risk situations, it is most important that the transducer and the associated driving circuit be in proper condition to function. However, units manufactured at present, i.e., the Sonalert, do not contain circuitry for indicating such "ready" state. In those cases where the indication of a "ready" state is needed, a test button is required together with periodic manual testing.

SUMMARY OF THE INVENTION

I have realized that a sonic alarm device of the electric, resonant type can advantageously be provided with a simple electrical background signal generator to make an inexpensive audible alarm in which the transducer can, in one mode, produce its audible tone representing an "alarm" condition and, in another mode, produce a low intensity, less coherent sound for indicating that the alarm device is operational but no alarm condition exists.

My audible alarm is very useful in a number of applications. For example, as part of a security system for buildings or explosives, the background sound of the ready state would not be noticed by the casual listener, but a security person who was specifically listening for the sound could easily recognize it. Similarly, my invention can be used with a smoke alarm or other such device, in place of or in conjunction with the LEDs used now to visually indicate alarm operability, to also provide an audible indication of operability.

For these purposes the invention employs a transducer mounted to resonate at a substantially specific natural resonant frequency, a resonant alarm circuit constructed in an alarm mode to drive the transducer at the resonant frequency to produce a distinct audible tone based upon the circuit reasonating at the natural frequency, and a switch having a first state for activating the alarm circuit in the alarm mode and a second state in which the alarm circuit is not in the alarm mode. According to the invention, the alarm device audibly indicates the second state of the switch by a non-resonant background signal generating means which produces a non-resonant signal to drive the transducer, the background signal generating means and the transducer being cooperatively constructed to produce an audible, status-indicating, relatively low intensity, background sound without discernible tone.

In preferred embodiments, the background signal generating means is constructed to produce a signal having a frequency and width extending over a substantial number of frequencies related to the resonant frequency of the transducer, in the ratio of small whole numbers (i.e. subharmonics and/or overtones). This relatively non-resonant signal can continue to be applied to the transducer when the switch moves into the first state with the driving resonant signal effectively swamping the non-resonant signal and producing an alarm tone.

In certain preferred embodiments, the noise generator is a super regenerator. Preferably it comprises a transistor which has a coil, a first capacitor connected between its base and collector, and a second capacitor connected across its emitter and collector, which produces a status indicating sound of a white-noise type. Preferably, in the super regenerator, a resistor is connected across the first capacitor to provide it with a discharge path.

In another preferred embodiment, the non-resonant signal generator is a blocking oscillator. The oscillator comprises a combination of a transformer and a resistor connected across the base-collector junction of an NPN transistor of the alarm circuit, and it drives the transducer to produce a series of audible clicks of a background nature, e.g. analagons to the ticking of a click.

In another embodiment, the non-resonant signal generator is a multivibrator which has a transistor with its collector connected to the base of an NPN transistor of the alarm circuit. The emitter of the PNP transistor is connected to the collector to the NPN transistor, and the base of the PNP transistor is connected to one terminal of the transducer so that the PNP transistor does not saturate in the second state so that it drives the transducer to produce a series of clicks.

In other preferred embodiments, the signal generator may be an amplifier with a feedback loop including a large carbon resistor so that thermal noise produced by the resistor is amplified by the amplifier and fed to the transducer. The signal generator may also be a sound generation chip configured to produce white noise at an output which is connected to the transducer.

The transducer of the presently preferred embodiment is a piezoelectric transducer with a vibratory surface which generates acoustic energy when energized. The alarm circuit includes a transistor amplifier and is appropriately phased, biased and impedance matched to oscillate at the resonant frequency of the transducer for generating the first audible signal. The non-resonant background signal generator drives the piezoelectric transducer in the second state at low levels permitting the transducer to behave much like a loud speaker to produce sound that can to such degree of fidelity track the frequencies of the background signal generator. The alarm circuit preferably has a transistor with its collector connected to the transducer and its emitter connected to ground through a resistor; the switch in its first state shorts out the emitter-connected resistor; the base of the transistor is connected to the transducer by a feedback loop; and the base is also connected to the signal generator.

DRAWINGS

I now turn to a description of the preferred embodiment of the invention, after first briefly describing the drawings.

FIG. 6 is a circuit diagram of a fourth embodiment of the invention, and

FIG. 7 is a circuit diagram of a fifth embodiment of the invention.

DESCRIPTION OF THE PRESENTLY PREFERRED EMBODIMENT

Figure 1:
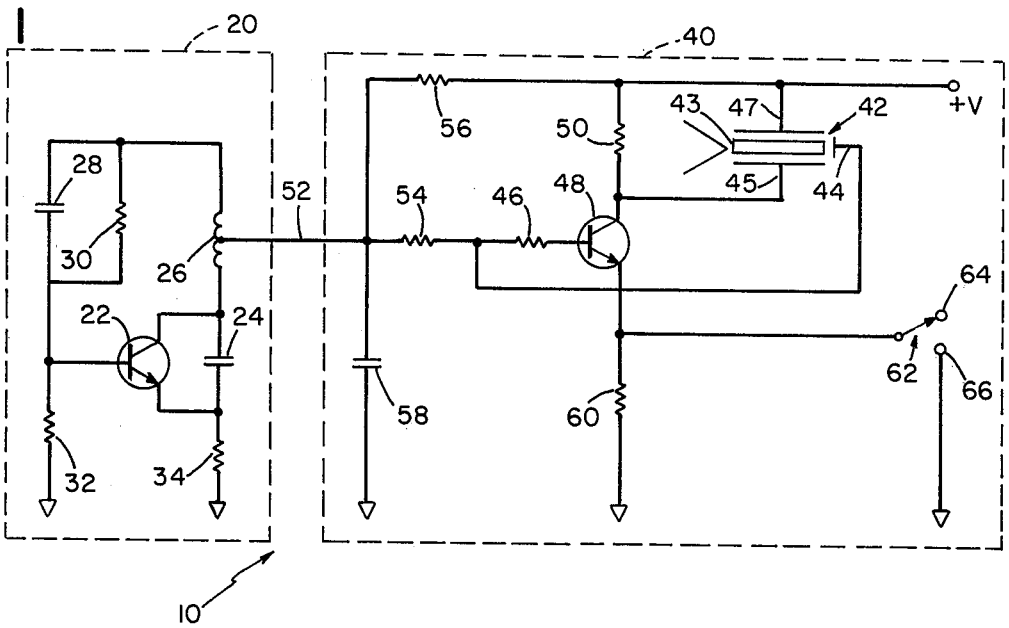
FIG. 1 is a circuit diagram of the background signal generator and alarm circuit of this invention.
Figure 2:
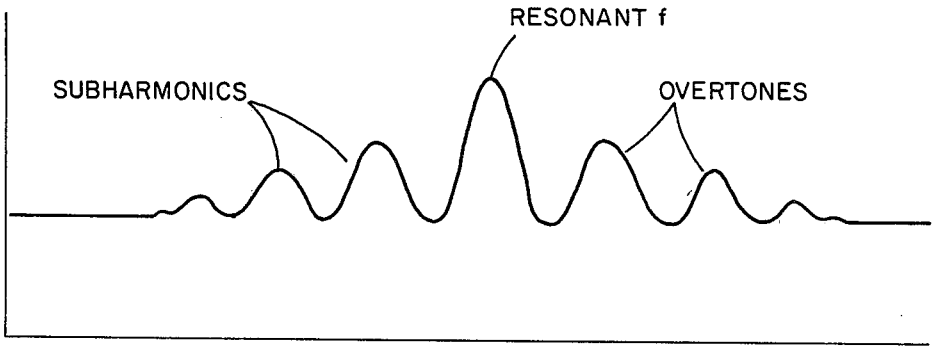
FIG. 2 is a graph of a signal showing a resonant frequency, subharmonics and overtones.

The audible alarm 10 of FIG. 1 generally comprises an electrical noise generator 20 and alarm circuit 40 which drive the audible transducer 42.

Noise generator 20, which may be an inexpensive RF stage for a CB receiver, has a transistor 22 with a capacitor 24 shunted across its collector and emitter. Transistor 22 is a 2N697, and capacitor 24 is 25 picofarads. The collector of transistor 22 is also connected to one terminal of a center-tapped coil 26. Coil 26 is a 16 turn, 3/16" coil which is shielded from radio frequency interference. The other terminal of coil 26 is connected to the base of transistor 22 through capacitor 38 of 0.005 farads. Resistor 30, which is 10 K ohms, is parallel to capacitor 28. Base of transistor 22 is connected to ground through a resistor 32 of 39 K ohms. Emitter of transistor 22 is also connected to ground through a resistor 34 of 43 ohms.

Figure 4:
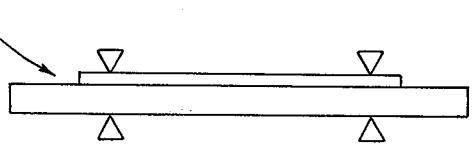
FIG. 4 is an enlarged side view of a nodal mounted transducer.

The alarm circuit 40, which is similar to a P.R. Mallory Sonalert alarm circuit, has a piezoelectric transducer 42, shown in FIG. 4 in a nodal mounting. Transducer 42 has a vibratory surface 43, a feedback electrode 44, a first terminal 45 and a second terminal 47. A resistor 50 of 560 ohms is connected between the first terminal 45 and the second terminal 47. Second terminal 47 is also connected to the positive side of a 9 volt power supply (not shown). Feedback electrode 44 is connected through a resistor 46 of 560 ohms to the base of a transistor 48, a 2N706. Collector of transistor 48 is connected to the first terminal of transducer 42. Emitter of transistor 42 is connected to ground through at 47 ohm resistor 60. Emitter is also connected to the pole of single pole switch 62. Switch 62 has an open terminal 64 and a closed terminal 66. Closed terminal 66 is connected to ground. The components of the alarm circuit 40 are phased, biased and impedance-matched in the usual manner so that the circuit 40 can operate as an oscillator.

An electrical lead 52 from the center tap of coil 26 of the noise generator 20 is connected through a 10 K ohm series resistor 54 to the feedback electrode 44. Lead 52 is connected also through a 5.6 K ohm resistor 56 to the positive side of the power supply. A 0.005 farad filter capacitor 58 connects lead 52 to ground.

OPERATION

In this presently preferred embodiment, noise generator 20, which is a super regenerator circuit, is activated when the power supply is turned on. Transistor 22 is forward biased, and an oscillation occurs between capacitor 24 and coil 26. Capacitor 28, however, partially charges on each cycle. After a number of cycles, capacitor 28 is fully charged, and this reverse biases transistor 22 thereby turning the transistor off. Capacitor 28 then discharges through resistor 30. This discharge restores the proper forward bias to transistor 22. Transistor 22 turns on again and the oscillations resume. This circuit therefore operates like a blocking oscillator. The resulting output on the lead 52 from the center tap of coil 26 is random or non-coherent noise, or rather a continuum of frequencies over a range of about 1000 cps to 10,000 cps, which is a good portion of the audible range for the human ear.

This random noise from the noise generator 20 is fed to the base of transistor 48 of the alarm circuit 40. Switch 62 is initially in the open position with its pole connected to open terminal 64. In this switch position, transistor 48 amplifies this noise slightly and feeds it from its collector to the terminal of transducer 42. Transducer 42 has a critical frequency at which surface 43 resonates sharply. While the transducer is relatively non-resonant for other frequencies, it is somewhat responsive to other frequencies, particularly to those frequencies related to the critical frequency. These related frequencies would be subharmonics and overtones, which are related to the critical frequency in the ratio of small whole numbers. These subharmonics and overtones are present in the continuum of frequencies which make up the noise from the noise generator 20. The resulting audio signal produced by the transducer in this mode is a "rush" noise or a non-coherent, white noise-type of sound. This sound of relatively low energy level provides a continuous audio indication that the alarm circuit is functioning but no alarm signal has been received.

In order to initiate an alarm signal, switch 62 is closed so that its pole contacts terminals 66. This connects the emitter of transistor 48 directly to ground and thereby increases the gain at the collector. The increased gain is sufficient to cause transducer to oscillate. The collector signal also appears on the feedback electrode 44 at the resonant frequency, and as this signal is fed back to the base of the transistor, it is amplified again until the collector saturates. The audio signal from the transducer in this resonant state is an alarm tone a distinctive, relatively intense alarm tone.

It is not necessary to prevent the noise output of the noise generator 20 from reaching the base of transistor 48 during the alarm signal mode because the oscillation is so dominant that it swamps the noise. Of course, a switch could be added at extra expense to break the lead 52 simultaneously with the closing of switch 62.

OTHER EMBODIMENTS

Figure 3:
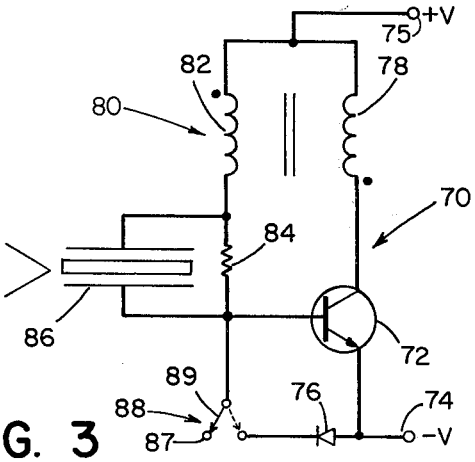
FIG. 3 is a circuit diagram of a second embodiment of the invention.

Another embodiment of this invention is shown by the circuit 70 of FIG. 3. The circuit 70 comprises a 2N930 transistor 72 having its emitter connected to a negative terminal 74 of a battery (not shown) and the anode of diode 76. The collector of transistor 72 is connected to one end of a first coil 78 of a transformer 80. The opposite end of the first coil 78 is connected to a positive terminal 75 of the battery. A second coil 82 of transformer 80 also has one end connected to the positive terminal 75, and the coil's opposite end is connected to the base of transistor 72 through a 10 megohm resistor 84. Transducer 86 is shunted across resistor 84. A switch 88 has its pole 89 connected to the base of the transistor 72. The pole 89 can contact an open terminal 87 (as shown in a solid line in FIG. 3) or the cathode of diode 76 (as shown by the dotted line).

In operation, the circuit 70 is initially in a non-alarm condition when the pole 89 is connected to the open terminal 87. In this state, the circuit 70 operates as a blocking oscillator, and the transducer 86 produces a series of quiet clicks at a rate of about one per second as long as the circuit 70 is operating properly and there is no alarm condition.

For an alarm condition, the pole 89 is connected to the cathode of diode 76. The circuit 70 drives the transducer 86 at its natural frequency causing the transducer to produce an alarm signal similar to the one in the preferred embodiment.

Because this circuit signals a non-alarm conditon by a series of clicks instead of a high gain white noise signal of the preferred embodiment, it draws very little current during the non-alarm period, and therefore can be used with a battery over a long period of time.

Figure 5:
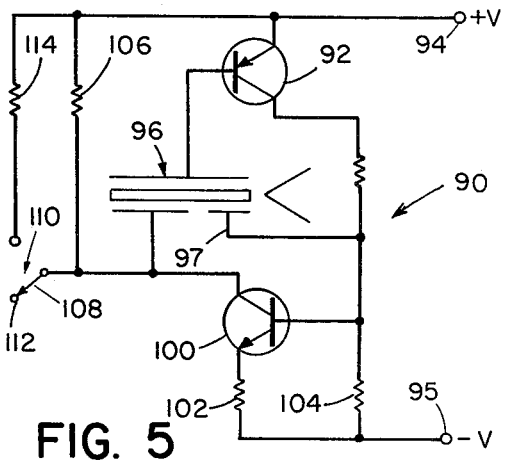
FIG. 5 is a circuit diagram of a third embodiment of the invention.

Another embodiment of this invention is shown by the circuit 90 of FIG. 5. This circuit 90 is essentially a completely transistorized version of the circuit 70 of FIG. 3. The circuit 90 comprises a PNP transistor 92 with its emitter connected to a positive terminal 94 of a battery (not shown). The base of transistor 92 is connected to a first terminal of a transducer 96, and the emitter of transistor 92 is connected through a 6 to 8 K ohm resistor 98 to the base of an NPN transistor 100. Both transistors 92, 100 have a $H_{fe}>80$. The collector of transistor 100 is connected to a second terminal of transducer 96, and a feedback electrode 97 of the transducer 96 is connected to the base of transistor 100. The emitter of transistor 100 is connected through a 270 ohm resistor 102 to a negative terminal 95 of the battery. A 1 K ohm resistor 104 also connects the base of transistor 100 to negative terminal 95.

A 10 megohm resistor 106 is shunted between the collector of transistor 100 and the positive terminal 94 of the battery. The collector of transistor 100 is also connected to a pole 108 of switch 110. Pole 108 can contact an open terminal 112 or a lead of 10 K ohm resistor 114. The other lead of resistor 114 is connected to the base of transistor 92.

In operation, the circuit 90 is in a non-alarm condition when the pole 108 of switch 110 is connected to the open terminal 112. In this mode, there is no feedback signal from the feedback electrode 97, and the transducer produces a series of clicks as in the previous embodiment. For an alarm condition, the pole 108 is connected to resistor 114, and transistor 92 saturates. There is feedback from feedback electrode 97, and the transducer is driven at its natural frequency thereby producing the alarm signal. As in the previous embodiment, there is a negligible drain in the battery in the non-alarm state. The circuit 120 of FIG. 6 has an amplifier 122 such as one of two available in a SN1458. The output of amplifier 122 is connected to a 10 K resistor 124 in series with a 0.1 farad capacitor 126. A 3 megohm carbon resistor 128 is connected from the junction of resistor 124 and capacitor 126 to the inverting input of amplifier 122. The non-inverting input of amplifier 122 is connected to the junction between a pair of 10 K ohm resistors 130, 132. The positive and negative terminals of the power source (not shown) are connected to amplifier 122 in the usual manner, as well as connected to resistors 130, 132 respectively.

Capacitor 126 is also connected to a first terminal 133 of switch 134. A pole 136 of switch 134 is connected to the base of 2N930 transistor 138. A 0.5 megohm resistor 140 is connected between the base and collector of transistor 138. The collector is also connected through a 5.6 K ohm resistor 142 to resistor 132. One terminal of transducer 144 is connected to the collector of transistor 138. The other transducer terminal is connected to the emitter and also to resistor 130. A feedback electrode 146 is connected to a second terminal 135 of switch 134.

In operation, the amplifier 122 has a low intensity white noise output due to the thermal noise created by carbon resistor 128. In a non-alarm condition, the white noise is fed to the base of transistor 138 when the switch pole 136 is in contact with the first terminal 133. The transistor 138 amplifies the signal and feeds it to transducer which produces an audible white connected to the feedback electrode 146, and the transducer 144 is driven at its natural frequency, thereby producing an alarm tone which is audibly different from the non-alarm white noise signal.

Another embodiment of this invention is shown by the circuit 150 of FIG. 7. In this circuit 150, a sound generating chip 152, which is a Texas Instruments SN 76477N, is used to produce the white noise for the non-alarm condition.

The chip 152 has a number of pins or contact points which are connected to the rest of the circuit in the following manner. Pin 14 of chip 152 is connected to the positive terminal of a 9 volt power supply 154. The negative terminal is directly connected to the mixer select pins 25, 26, the envelope select pin 1, the external noise clock pin 3, and the system enable pin 9. Also, mixer select pin 27, envelope select pin 28 and voltage regulator pin 15 are externally connected together. Pin 4, which is a noise clock control, is connected to a 39 K ohm resistor 156. The noise filter control pin 5 is connected to 47 K ohm resistor 157. Pin 10, the attack control, is connected to 11 K ohm resistor 158, and amplitude control pin 11 is connected to 150 K ohm resistor 159. The opposite leads of all these resistors 156–159 are connected to the negative terminal of the power supply 154. Another noise filter control pin 6 is connected to the negative terminal through 390 picofarad capacitor 160.

2N930 transistor 162 has its base connected to a pole 164 of a switch 166. A first contact 168 for the switch 166 is connected to the audio output pin 13 of chip 15 and also through 10 K ohm resistor 169 to the negative terminal of the power supply 154. The base of transistor 162 is connected to the positive terminal of the power supply 154. The second contact 170 of the switch 166 is connected to a feedback electrode 172 of a transducer 174. The emitter of transistor 162 is connected to a first terminal of transducer 174 and through 47 K ohm resistor 176 to the feedback resistor pin 12 of chip 152, and through 470 ohm resistor 177 to the terminal of power supply 154.

The feedback electrode 172 is connected through a 0.5 megohm resistor 180 to a second terminal of the transducer 174, which transducer terminal is connected to the negative terminal of the power supply 154. A 0.3 megohm resistor 182 connects the feedback electrode 172 with the positive terminal of the power supply 154.

In operation, the chip 152 is configured to produce white noise as an output at pin 13. When the circuit is in a non-alarm condition, the pole 164 of switch 166 connects with the first contact 168, and the white noise is fed to the base of the transistor 162. As previously explained, the transducer will then produce a white noise-type sound. For an alarm signal, the pole 164 is connected to the second contact 170 of the switch 166 thereby removing the white noise from the base of the transistor 162 and instead connecting the base with the feedback electrode 172. The transducer 174 is then driven at its natural frequency, and it produces an alarm tone as in the previous embodiments.

Other circuits will be apparent to those skilled in the art. For example, in the last described embodiment, other chips such as a National Semiconductor MM5837 can be used with slight modifications to the circuit. Also, a number of other white noise generators exist and may be used in connection with this invention.

What is claimed is:

1. In an audible alarm device comprising a transducer mounted to resonate at a substantially specific natural resonant frequency, a resonant alarm circuit constructed in an alarm mode to drive said transducer at said resonant frequency to produce a distinct audible tone based upon said circuit resonating at said natural frequency, and a switch having a first state for activating said alarm circuit in said alarm mode, and a second state in which said alarm circuit is not in said alarm mode, the improvement that enables said alarm device to audibly indicate said second state of said switch comprising a non-resonant, background signal generating means which produces a non-resonant signal in relation to said transducer, to drive said transducer, said signal generating means and said transducer cooperatively constructed to produce an audible, status-indicating relatively low intensity background sound, without discernible tone.

2. The audible alarm device of claim 1 wherein said background signal generating means is constructed to produce a signal having a bandwidth containing a substantial number of frequencies related to said resonant frequency of said transducer in the ratio of small whole numbers.

3. The audible alarm device of claim 2 wherein said non-resonant signal contains frequencies over a substantial portion of the ear's response range, said transducer being responsive to said frequencies to generate said status indicating sound in said second state.

4. The audible alarm device of claim 1, 2 or 3 wherein said non-resonant signal is applied to said transducer when said switch is in both its first and second states and said alarm tone effectively swamps said non-resonant signal when said switch is in said first state.

5. The audible alarm device of claim 1, 2 or 3 wherein said non-resonant signal generating means comprises a super-regenerator.

6. The audible alarm device of claim 5 wherein said super-regenerator comprises a transistor, a coil connected in series with a first capacitor across the collector and base of said transistor, said first capacitor having a discharge means, and a second capacitor connected across the emitter and collector of said transistor so that said status indicating sound of said second state is a white noise type of sound.

7. The audible alarm device of claim 6 wherein said discharge means is a resistor shunted across said first capacitor.

8. The audible alarm device of claim 1 wherein said non-resonant background signal generating comprises a blocking oscillator.

9. The audible alarm device of claim 1 wherein said non-resonant background signal generating means is constructed to produce a series of pulses effective to drive said transducer to provide a series of audible clicks.

10. The audible alarm device of claim 9 wherein said non-resonant background signal generating means is a blocking oscillator comprised of the combination of a transformer and a resistor, said combination being connected across the base-collector junction of an NPN transistor of said alarm circuit, said oscillator producing a signal which drives said transducer to produce said series of audible clicks.

11. The audible alarm device of claim 1 wherein said non-resonant background signal generating means comprises a multivibrator.

12. The audible alarm device of claim 9 wherein said background signal generating means is a multivibrator comprised of an PNP transistor with its collector connected to the base of an NPN transistor of said alarm circuit, the emitter of said PNP transistor being connected to the collector of said NPN transistor, and the base of said PNP transistor being connected to one terminal of said transducer so that said PNP transistor does not saturate when said switch is in its second state and said multivibrator produces a signal which drives said transducer to generate said series of audible clicks.

13. The audible alarm device of claim 1 wherein said non-resonant signal generating means comprises an amplifier with a feedback loop including a large carbon resistor so that thermal noise produced by said resistor is amplified by said amplifier and fed to said transducer as said non-resonant background signal.

14. The audible alarm device of claim 13 wherein said thermal noise signal from said amplifier is white noise, and said signal only being applied to said alarm circuit when said switch is in its second state so that said status indicating sound is a white noise type of sound.

15. The audible alarm of claim 1 wherein said signal generating means comprises a sound generation chip configured to produce white noise at an output, said output being connected to said transducer so that said status indicating sound is a white noise type of sound.

16. The audible alarm device of claim 1 wherein said transducer is a piezoelectric transducer having a vibratory surface from which acoustic energy is radiated and a piezoelectric means operative to drive said surface, said alarm circuit being constructed to energize said piezoelectric means, said circuit including amplifier means with a transistor actuator, means for conducting energy from said piezoelectric means to said amplifier, the circuit including means to provide phasing, biasing, and impedance matching to provide an oscillator whereby the energy input to said piezoelectric means is caused to oscillate substantially at said resonant frequency of said transducer to provide said first audible signal, and said non-resonant signal generating means adapted to drive said piezoelectric transducer when said switch is in its second state.

17. The audible alarm device of claim 16 wherein said signal generating means introduces said signal to said transducer to drive said alarm circuit in said second state.

18. The audible alarm device of claim 16 wherein said piezoelectric means comprises a piezocrystal included directly in an oscillator feedback loop.

19. The audible alarm device of claim 16 wherein said alarm circuit comprises a transistor having a collector connected to said transducer, an emitter of said transistor being connected to ground through a resistor, said switch being connected to short out said resistor in its first state, and a feedback loop connected from said transducer to a base of said transistor.

20. The audible alarm device of claim 19 wherein said signal from said signal generating means is applied to the base of said transistor.

* * * * *